United States Patent [19]

Plaskett

[11] Patent Number: 4,584,818

[45] Date of Patent: Apr. 29, 1986

[54] APPARATUS FOR AUTOMATICALLY CLOSING L-SLIDE LOCK CARTONS

[75] Inventor: John Plaskett, Dallas, Tex.

[73] Assignee: Frito-Lay, Inc., Dallas, Tex.

[21] Appl. No.: 767,594

[22] Filed: Aug. 20, 1985

[51] Int. Cl.[4] ..... B65B 7/24

[52] U.S. Cl. ..... 53/374; 493/136; 493/453

[58] Field of Search ..... 53/374, 376, 377, 484, 53/564; 493/137, 136, 139, 453, 183

[56] References Cited

U.S. PATENT DOCUMENTS

| | | | |
|---|---|---|---|
| 2,277,289 | 3/1942 | Bergstein et al. | 493/135 |
| 2,660,012 | 11/1953 | Boyce et al. | 53/376 |
| 3,002,432 | 10/1961 | Wendshuh | 493/263 |
| 3,960,313 | 6/1976 | Sax et al. | 206/167 X |
| 4,007,869 | 2/1977 | Stolkin et al. | 229/41 B |
| 4,441,303 | 4/1984 | Langen | 53/374 |

*Primary Examiner*—James F. Coan

*Attorney, Agent, or Firm*—Bernard, Rothwell & Brown

[57] ABSTRACT

An apparatus for automatically closing L-slide lock cases travelling with the lateral axis in the direction of travel and stopped intermittently for closing includes selectively positionable support rods for defining a fold line in an open flap, a flap fold member for folding the open flap over the support rods line and moving the top edge of the open flap adjacent the L-slide locks, and a flap tucking member operable on the folded open flap to slide it into the L-slide lock and flatten out the fold. Each of the members may be driven by cylinders in an appropriate sequential manner to accomplish these folding and tucking operations.

16 Claims, 9 Drawing Figures

APPARATUS FOR AUTOMATICALLY CLOSING L-SLIDE LOCK CARTONS

BACKGROUND OF THE INVENTION

1. Field of the Invention

This invention relates to improvements in apparatus for closing foldable cartons or cases, and more particularly relates to an apparatus for automatically closing a top flap of an L-slide lock case.

2. Description of Background Art

There is much prior art on apparatus for setting up as well as closing cartons and the like utilizing various members to contact carton flaps and tuck or insert them for closing purposes. U.S. Pat. Nos. 2,660,012 and 3,002,432 are exemplary of such prior art.

Cartons having L-slide locks are commercially available from Stone Container Corp. Such cartons or cases are used by Frito-Lay, Inc. to package bags of snack foods such as potato chips, corn chips, and the like, for shipment. The L-slide locks on the cartons make them easy to close by just inserting the opposite ends of an upstanding flap into the lock slots. L-slide lock cases are used for shipment of snack bags because they are re-usable and can be closed without the use of glue, staples, tape, or other destructive closure means. When the cases are emptied, they are collapsible as set forth in U.S. Pat. Nos. 3,960,313 and 4,007,869, for ease in shipment back to the factory to be refilled. Prior to the present invention, the L-slide lock cases were manually closed after the bags of product were packed into the case. The obvious drawbacks to manual closing are that it is a labor-intensive, time-consuming and hence extremely expensive.

There is need in the art for an automatic case closing apparatus for L-slide lock cartons. This need has existed for some time until the present invention.

SUMMARY OF THIS INVENTION

This invention provides an apparatus for automatically closing L-slide cases in which cases are travelling laterally of their longitudinal axis and intermittently. Folding means form a longitudinal fold in an upstanding open closing flap of the case, the flap having a free longitudinal edge extending laterally across the direction of travel. The fold is formed while the case is held stationary, so that the free longitudinal edge of the closing flap is positioned at about a level with the top of the case, and opposite free end corners of the closing flap are positioned adjacent respective L-slide lock slots in the top of the case. Means for tucking the opposite free end corners of the closing flap into respective L-slide lock slots close the case while it is held stationary by guiding the longitudinal fold of the closing flap to a position at about a level with a top level of the case.

DETAILED DESCRIPTION OF THE PREFERRED EMBODIMENTS

Figure 1:
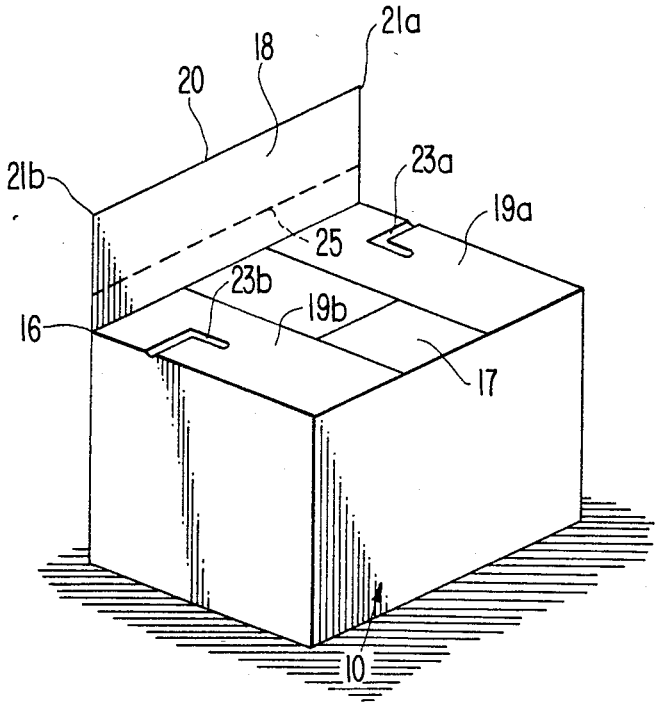
FIG. 1 is a perspective view of an L-slide lock case with the closing flap in the open position.

Referring to FIG. 1, a case 10 of the L-slide lock type commercially available from Stone Container Corp. has previously been packed and needs to be closed. The case travels on a conveyor 12 of any suitable type such as belt, roller, chute or the like in the direction of arrow 14 in FIG. 2A which, as can be seen, is transverse to the longitudinal axis or the long direction of case 10. Conveyor 12 is provided to move the cases 10 intermittently and transverse to their longitudinal axes to a predetermined stationary position relative to the apparatus of this invention, stop the case at that predetermined position and hold the case stationary at that position during the closing operation.

In the closing position the case top 16 has extending from a long side thereof an open closing flap 18. See FIG. 1. Top 16 also includes three other flaps 17, **19*a* and 19*b* which have previously been placed in the closed position shown in FIG. 1 by means not shown. During the closing operation, the outer free longitudinal edge 20 of open closing flap 18 has its opposite free end corners 21*a* and 21*b* tucked into the respective L-slide lock slots 23*a* and 23*b* of closed side flaps 19*a* and 19*b*** respectively.

Prior to this invention, such operation of tucking the corners **21*a* and 21*b* of the open flap 18 into respective L-slide slots 23*a* and 23*b*** was a manual operation. This invention automates what was previously a manual operation.

An apparatus according to this invention includes means for folding the open closing flap 18 to form a longitudinal fold 25 in the closing flap 18 at a predetermined position between the top 16 of the case and the free longitudinal edge 20 of flap 18. Preferably, flap 18 has been previously scored by the manufacturer along the line at the position where fold 25 is formed.

According to one embodiment, the closing flap folding means comprises fold support rods 22 and 24 which may be piston rods of cylinders 26 and 28 respectively which cylinders are rigidly mounted on suitable supports 30. See FIGS. 2A and 2B. Support rods 22 and 24 are selectively positionable to and from a position adjacent the inside surface of the open flap 18 when the open flap extends upwardly, and parallel to the edge of the carton. The reference to "inside" with regard to flap 18 means on the side of the flap toward the center of the carton as distinguished from the "outside" which is the side of the flap away from the center of the carton.

The closing flap folding means includes a flap fold guide rod 32 which is connected at each end to levers 34 and 36, the guide rod 32 being positioned to contact the outside surface of the open closing flap 18. Each of these levers is pivoted about stationary pivots **38*a*** and 38*b*. A driving cylinder 40 is attached to the end of rod 34, the cylinder being pivotedly supported from a support 42. Actuation of the cylinder 40 moves rod 32 to drive the flap fold guide rod 32 over the top of the support rods 22 and 24 to fold the flap in the position shown in FIG. 3, wherein the longitudinal edge 20 of closing flap 18 is positioned at about a level with the top of the case, and opposite free end corners 21*a* and 21*b* of flap 18 are positioned adjacent respective L-slide lock slots 23*a* and 23*b*. See FIGS. 3 and 4.

Means are provided for tucking the opposite free end corners 21*a* and 21*b* of closing flap 18 into respective L-slide lock slots 23*a* and 23*b* while the case is held stationary. The tucking means is positioned to contact an outside surface of the closing flap, the tucking means including means for guiding the longitudinal fold 25 of closing flap 18 to a position at about a level with the top of the case to cause each of the free end corners to enter the respective L-shaped slots due to the resiliency of the folded top flap, thereby completely closing the case.

Figure 5:
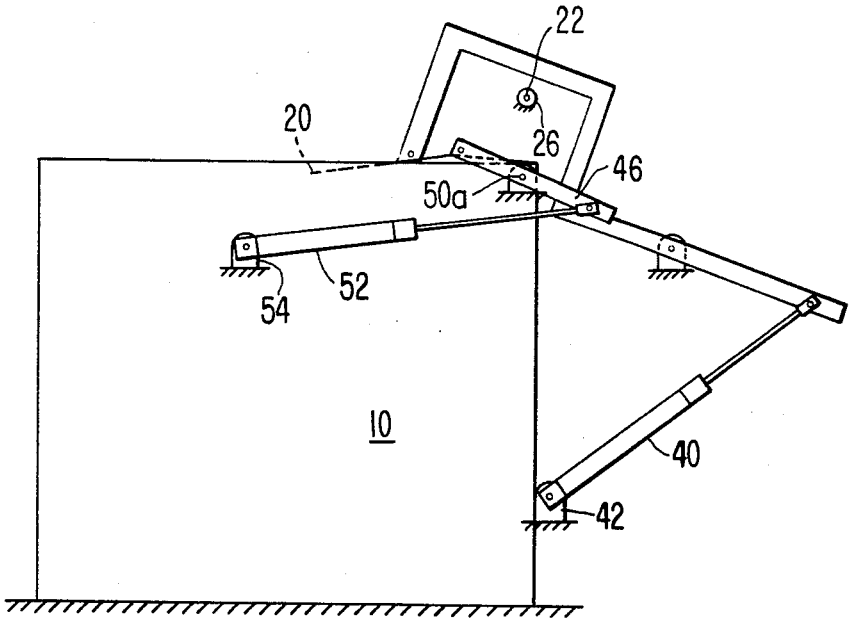
FIG. 5 is a side elevation view similar to FIG. 2A showing the apparatus in the final stage of operation wherein the carton is closed.

According to one embodiment, the flap tucking means includes a tucking member in the form of rod 44, the ends of which are connected to links 46 and 48. See FIG. 2A. Each of these links 46 and 48 pivots about stationary pivots 50*a* and 50*b*. Link 46 is driven by cylinder 52 pivoted to stationary support 54. See FIG. 3. Actuation of cylinder 52 drives rod 44 to guide the fold flap and close the case as shown in FIG. 5.

Figure 2A:
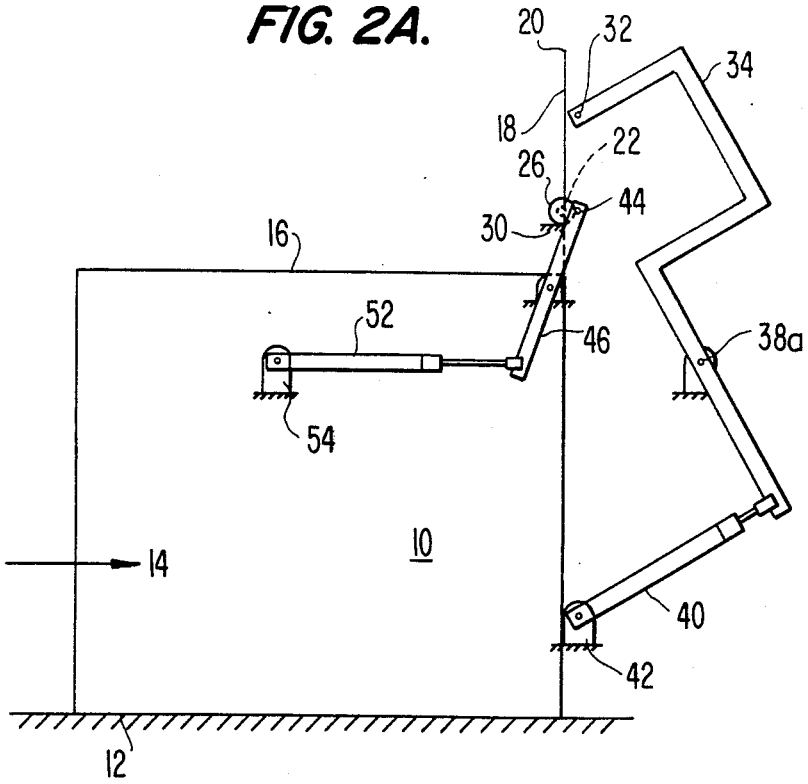
FIG. 2A is a side elevation view of a case and an automatic closing apparatus according to this invention.
Figure 2B:
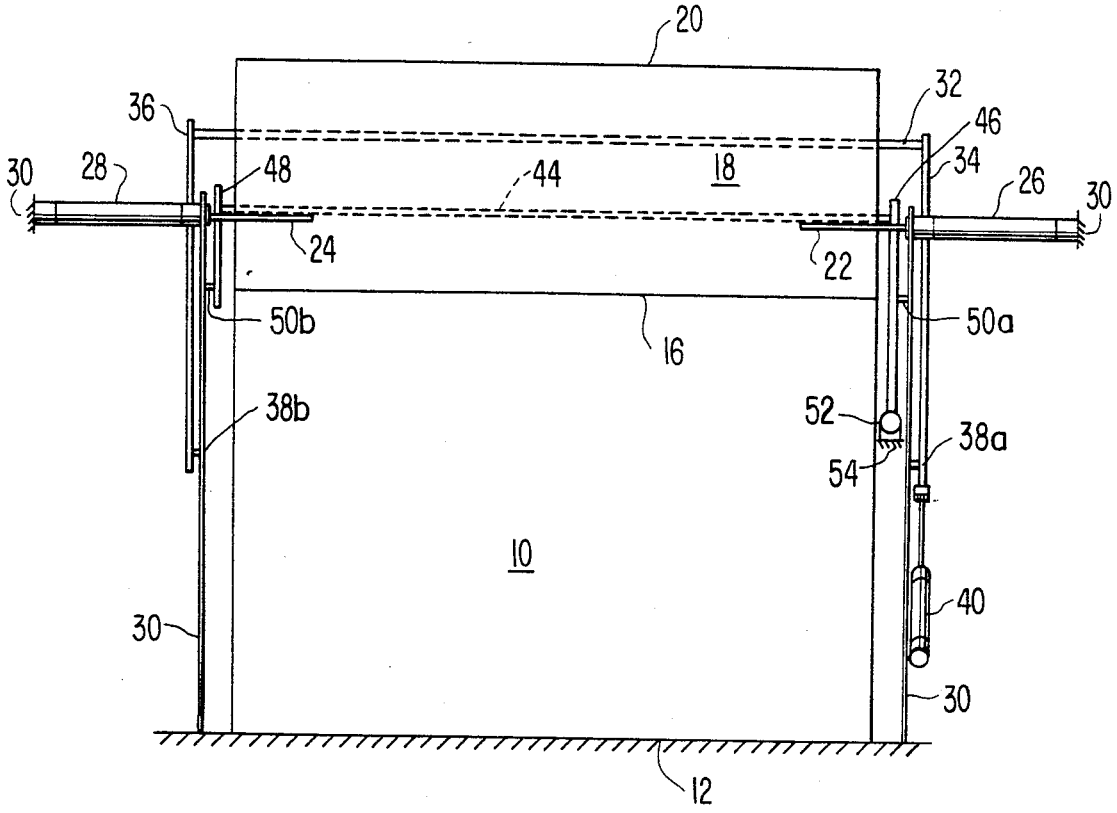
FIG. 2B is a front elevation view of the carton and the automatic closing apparatus of this invention.

In operation of the invention the start position is with cylinders 26, 28, 40 and 52 retracted so that the conveyor 12 can move the carton 10 into the position shown in FIG. 2A with flap 18 open and extending vertically upwardly from the top 16 of the carton in its position shown.

In the first step of the flap closing operation cylinder 26 and 28 extend moving fold support rods 22 and 24 to the inside surface of flap 18 above the level of the top of the carton a predetermined and predesired distance which will determine where the flap 18 is to be temporarily folded. See FIG. 2B.

Figure 3:
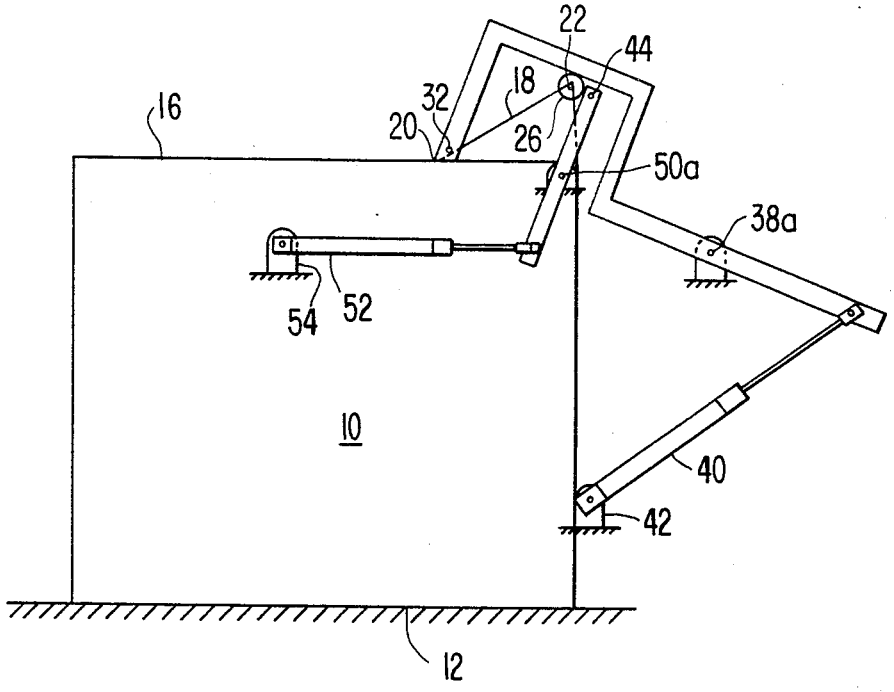
FIG. 3 is a side elevation view similar to FIG. 2A showing the apparatus in an intermediate stage of operation wherein the open flap is folded.
Figure 4:
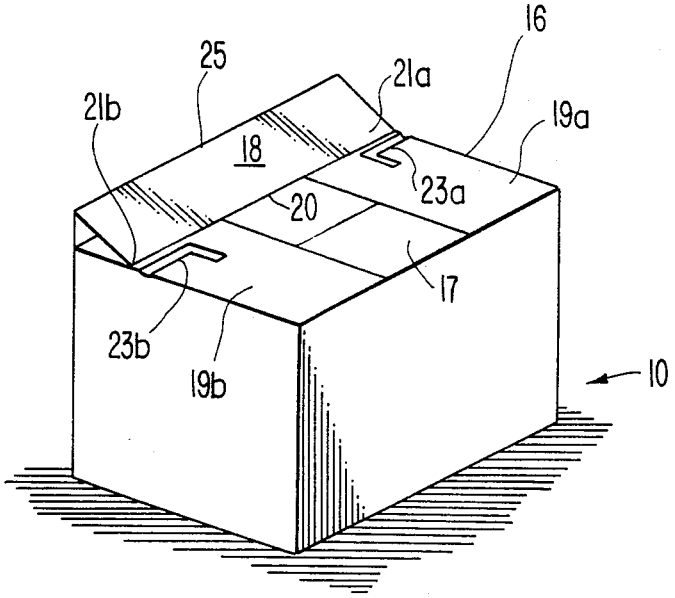
FIG. 4 is a perspective view similar to FIG. 1 wherein the open case flap is folded prior to closing.

The next step in the cycle is the extension of cylinder 40 and this is as shown in FIG. 3. With cylinder 40 extended the fold flap guide rod 32 will contact the outside of the open flap 18 and move the flap top edge 20 downwardly and inwardly toward the center of the carton temporarily folding it about a longitudinal fold line 25 defined by the level of the guide rods 22 and 24 with guide rods 22 and 24 supporting the fold. Extension of the cylinder 40 moves the flap fold guide rod 32 to the position of FIG. 3 so that the edge 20 of the flap 18 is at the top surface 16 and heading downwardly just outside the L-shaped slots in the top as shown in FIG. 4.

The next step is shown in FIG. 5 in which cylinders 26 and 28 retract moving fold support rods 22 and 24 out of the way and at the same time cylinder 52 extends causing the flap tucking rod 44 to contact the back edge of the folded flap and move it downwardly and inwardly as shown in FIG. 5. This causes the corners of the top edge 20 of the open flap 18 to be tucked into the L-shaped slots quickly, efficiently, and automatically.

The next step is a return to the original start position in which cylinders 40 and 52 retract and the conveyor 12 moves the box away from the apparatus and allows another box to enter to be positioned for automatic closing.

The height of the closing apparatus above the conveyor can be made adjustable for closing cases of different heights.

Figure 8:
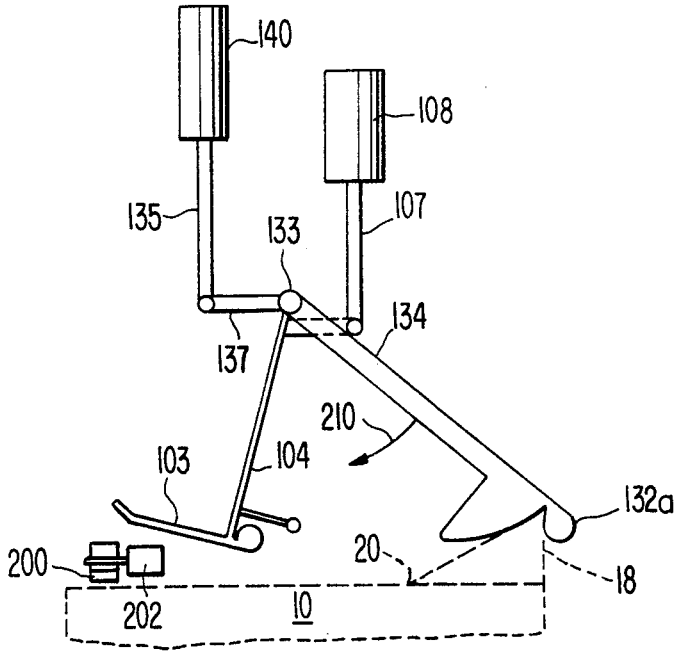
FIG. 8 is a side elevation view with portions broken away of the apparatus shown in FIGS. 6 and 7 at an intermediate case closing stage.

In another embodiment, means are provided for automatically closing all four top flaps of an L-slide lock carton. According to this embodiment, an upstanding flap 17 is closed first, and both of upstanding flaps 19*a* and 19*b* are then closed before the folding and closing of closing flap 18. See FIGS. 1 and 4. An apparatus according to this embodiment is shown in FIGS. 6, 7 and 8.

Figure 6:
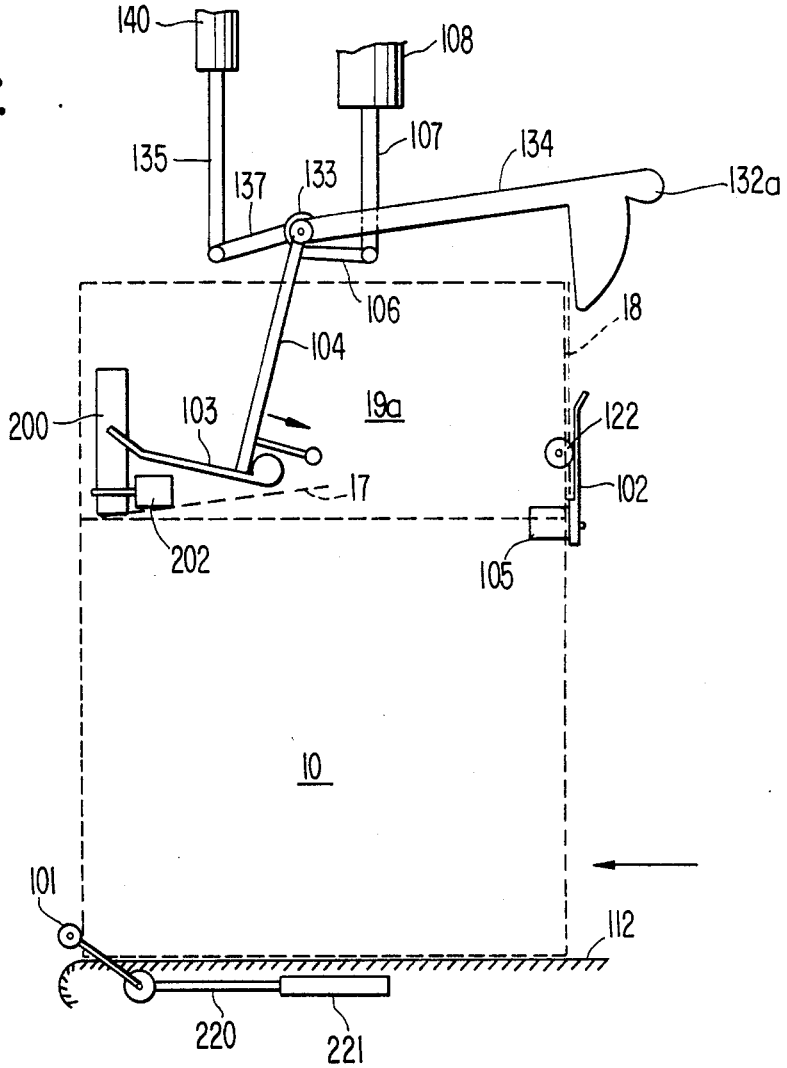
FIG. 6 is a side elevation view of an automatic closing apparatus according to a second embodiment of this invention.
Figure 7:
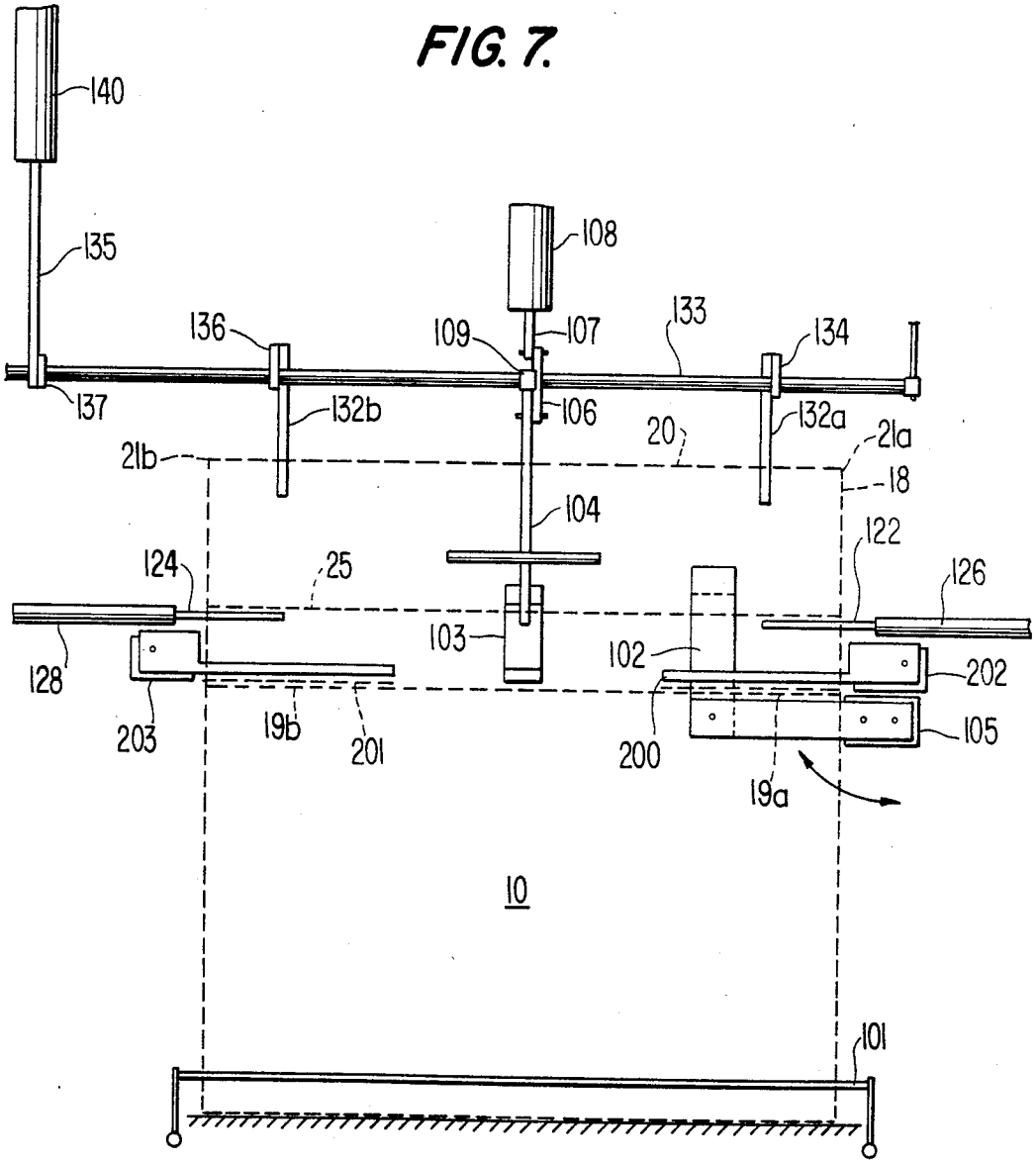
FIG. 7 is a front elevation view of the apparatus shown in FIG. 6.

According to this embodiment, conveyor 112 moves a case 10 with all flaps open into the position shown in FIG. 6, wherein the box is stopped by a bar 101 extending transversely across and slightly above conveyor 112. Rotary cylinder 105 then moves pivoting arm 102 up behind case 10 to the position shown in FIGS. 6 and 7, to hold the case in place against bar 101 for closing.

It can be seen in FIG. 6 that flap 17 of case 10 is partially closed by boot 103 when case 10 is moved into position against bar 101 for closing.

Boot 103 is rotatably connected to bar 133 by means of leg 104 and bearing 109. With arm 102 and bar 101 in the position shown in FIGS. 6 and 7, boot 103 pivots rearwardly to the position shown in FIG. 7 to completely close flap 17. Rearward movement of boot 103 is accomplished by means including lever 106 connecting leg 104 with piston rod 107 and cylinder 108, which cylinder is mounted on a suitable support (not shown).

With flap 17 closed, flap slappers 200 and 201 close flaps 19*a* and 19*b* respectively, over flap 17. See FIG. 7. Flap slappers 200 and 201 are driven from the upstanding vertical position shown in FIG. 6 to the horizontal position shown in FIG. 7 by rotary cylinders 202 and 203, respectively, the rotary cylinders being mounted on suitable supports (not shown). The case is now ready for the closing of flap 18.

According to this embodiment, the closing flap folding means comprises fold support rods 122 and 124 which may be piston rods of cylinders 126 and 128 respectively, which cylinders are rigidly mounted on suitable supports (not shown). As can be seen in FIG. 6, the position of the rods 122 and 124 is just inside of the open closing flap 18 when the open flap extends upwardly, and parallel to the edge of the carton. The reference to "inside" with regard to flap 18 again means on the side of the flap toward the center of the carton as distinguished from the "outside" which is the side of the flap away from the center of the carton.

The closing flap folding means includes a pair of flap fold guide shoes 132*a* and 132*b* fixedly attached to pivot bar 133 by means of levers 134 and 136, respectively. A driving cylinder 140 is attached to an end portion of bar 133 by means of piston rods 135 and lever 137, the cylinder being supported by a suitable support (not shown). Actuation of the cylinder 140 moves rod 132 to the position shown in FIG. 8, wherein the longitudinal edge 20 of closing flap 18 is positioned at about a level with the top of the case, and opposite free corners 21*a* and 21*b* of flap 18 are positioned adjacent respective L-slide lock slots 23*a* and 23*b*. See FIGS. 4 and 8.

Shoes 132*a* and 132*b* provide the means for tucking the opposite free end corners 21*a* and 21*b* of closing flap 18 into respective L-slide lock slots 23*a* and 23*b*. Shoes 132*a* and 132*b* guide the longitudinal fold 25 of closing flap 18 to a position at about a level with the top of the case to cause each of the free end corners to enter the respective L-shaped slots due to the resiliency of the folded top flap, thereby completely closing the case. This is accomplished by continued downward and inward movement of shoes 132*a* and 132*b* from the position shown in FIG. 8 in the direction of arrow 210 under the power of cylinder 140.

When the case is completely closed, bar 101 drops down by retraction of rod 220 by cylinder 221, the cylinder being mounted on a suitable support (not shown). Pivoting arm 102 is returned to its downward position, conveyor 112 moves case 10 along, and the other components of the apparatus move to the position shown in FIG. 6 in preparation for closing another case.

While embodiments of this invention have been shown and described in some detail, it will be understood that this description and the accompanying drawings are offered merely by way of example, and are not to be construed as limiting.

I claim:

1. Apparatus for automatically closing the top of a case having an open closing flap and L-slide lock slots for receiving opposite free end corners of the closing flap, the cases travelling transverse to their longitudinal axes and travelling intermittently, the cases being stationary during the operation of the apparatus, the apparatus comprising:

(a) means for holding a case at a predetermined stationary position relative to the apparatus, the case having a top portion which includes an open closing flap connected to the top of the case, the closing flap having a free longitudinal edge and opposite free end corners, the top portion further including L-slide lock slots for receiving respective free end corners of the closing flap;

(b) means for folding the open closing flap to form a longitudinal fold in the closing flap while the case is held stationary, the fold being between the top of the case and the free longitudinal edge of the closing flap so that the free longitudinal edge of the closing flap is positioned at about a level with a top level of the case and the opposite free end corners of the closing flap are positioned adjacent respective L-slide lock slots; and (c) means for tucking the opposite free end corners of the closing flap into the respective L-slide lock slots while the case is held stationary, the tucking means including means for guiding the longitudinal fold of the closing flap to a position at about a level with a top level of the case to cause each of the free end corners to enter the respective L-shaped slots and thereby close the top of the case.

2. Apparatus as defined in claim 1 further comprising means for moving said cases to said predetermined stationary position and stopping said case at said predetermeined stationary position.

3. Apparatus as defined in claim 1 wherein the means for folding the closing flap include means for supporting said fold, the fold supporting means being selectively positionable to and from a position adjacent an inside surface of the open flap at a desired fold position above a top level of the case, and further including means for driving the fold supporting means to and from said adjacent position, wherein the fold supporting means is positioned adjacent the inside surface of the open flap when the fold is formed and removed from said adjacent position before the case is closed; the means for folding the closing flap further including a flap fold guide positioned to contact an outside surface of the open closing flap and means for driving the flap fold guide over the top of the fold supporting means to fold the flap and to position the free longitudinal edge of the flap at about a level with the top level of the case and the opposite free end corners of the closing flap adjacent respective L-slide lock slots.

4. Apparatus as defined in claim 1 wherein the flap tucking means includes a tucking member positioned to contact an outside surface of the closing flap and guide the closing flap to a position at about a level with a top level of the case and cause each of the free end corners to enter respective L-shaped slots and thereby close the top of the case, and further including means for driving the tucking member to guide the folded flap and close the case.

5. Apparatus as defined in claim 2 wherein the flap tucking means includes a tucking member positioned to contact an outside surface of the closing flap and guide the closing flap to a position at about a level with a top level of the case and cause each of the free end corners to enter respective L-shaped slots and thereby close the top of the case, and further including means for driving the tucking member to guide the folded flap and close the case.

6. Apparatus as defined in claim 3 wherein the fold support means includes separate rods positionable inside the surface of the open flap.

7. Apparatus as defined in claim 5 wherein the fold support means includes separate rods positionable inside the surface of the open flap.

8. Apparatus as defined in claim 6 wherein the fold support drive means comprises separate drive cylinders, one for each rod.

9. Apparatus as defined in claim 7 wherein the fold support means comprises separate rods positionable inside the surface of the open flap.

10. Apparatus as in claim 3 wherein the flap fold guide is a rod.

11. Apparatus as in claim 4 wherein the flap fold guide is a rod.

12. Apparatus as in claim 5 wherein the flap fold guide is a rod.

13. Apparatus as in claim 11 wherein the flap fold guide drive means is a drive cylinder attached to one end of a pivoted lever, the other end of the pivot lever connected to the flap fold guide rod.

14. Apparatus as in claim 12 wherein the flap fold guide drive means is a drive cylinder attached to one end of a pivoted lever, the other end of the pivot lever connected to the flap fold guide rod.

15. Apparatus as in claim 4 wherein the flap tucking means comprises a rod.

16. Apparatus as in claim 15 wherein the flap tucking drive means includes a drive cylinder and a pair of links, one end of one link attached to the flap tucking rod and the other end of at least one of the links attached to the drive cylinder.

* * * * *